US006347467B1

(12) United States Patent
Meyer

(10) Patent No.: US 6,347,467 B1
(45) Date of Patent: Feb. 19, 2002

(54) PHOTOGRAPH DISPLAY SYSTEM

(76) Inventor: Judi A. Meyer, 11063 U.S. 42, Union, KY (US) 41091

( * ) Notice: Subject to any disclaimer, the term of this patent is extended or adjusted under 35 U.S.C. 154(b) by 0 days.

(21) Appl. No.: 09/480,232

(22) Filed: Jan. 10, 2000

(51) Int. Cl.[7] ..... A47G 1/06
(52) U.S. Cl. ..... 40/124.06; 40/729; 40/775
(58) Field of Search ..... 40/124.06, 124.09, 40/703, 725, 729, 733, 765, 766, 774, 775, 779, 780, 786, 709, 124.13

(56) References Cited

U.S. PATENT DOCUMENTS

| | | | | | |
|---|---|---|---|---|---|
| 1,550,211 | A | * | 8/1925 | Euwer | 40/124.09 |
| 2,367,381 | A | * | 1/1945 | Szymlek | 40/124.09 |
| 2,547,359 | A | | 4/1951 | Bacharach | |
| 2,878,607 | A | | 3/1959 | Alves | |
| 2,926,444 | A | | 3/1960 | Atkins | |
| 3,481,063 | A | | 12/1969 | Udesen | |
| 3,545,115 | A | * | 12/1970 | Nichols | 40/124.09 |
| 4,110,923 | A | * | 9/1978 | Shore | 40/152 |
| 253,507 | A | | 11/1979 | English | |
| 253,742 | A | | 12/1979 | English | |
| 4,200,222 | A | | 4/1980 | Feuer | |
| 4,529,385 | A | * | 7/1985 | Reiner et al. | 434/171 |
| 4,830,404 | A | * | 5/1989 | Lu | 281/2 |
| 4,890,402 | A | | 1/1990 | Carroll | |
| 4,991,767 | A | | 2/1991 | Wyant | |
| 5,269,084 | A | | 12/1993 | Best et al. | |
| 5,303,487 | A | | 4/1994 | Olson | |
| 5,375,351 | A | | 12/1994 | King et al. | |
| 5,409,381 | A | * | 4/1995 | Sundberg et al. | 434/159 |
| 393,749 | A | | 4/1998 | Krohn | |
| 5,787,617 | A | * | 8/1998 | Testa | 40/124.06 |
| 6,058,640 | A | * | 5/2000 | Young | 40/709 |
| 6,163,991 | A | * | 12/2000 | Drapcho et al. | 40/124.09 |

* cited by examiner

*Primary Examiner*—Lynne H. Browne
*Assistant Examiner*—Kenn Thompson
(74) *Attorney, Agent, or Firm*—Wood, Herron & Evans, L.L.P.

(57) ABSTRACT

The photograph display system is formed from a plurality of sections which are separated from each other by perforation lines that allow them to be folded in an accordion fashion. Each section has a pocket. One side of the pocket is cut out to allow viewing of a photograph. The photograph is placed in the pocket along with a panel. The panel has a cut out portion that allows the photograph to be viewed. The cut out portion is in the form of an alpha numeric character. This allows selection of different panels with different cut out portions to be used in separate sections to thereby provide a word such as "thanks" or the like.

9 Claims, 2 Drawing Sheets

PHOTOGRAPH DISPLAY SYSTEM

BACKGROUND

There are many different ways to display photographs. Picture frames are the most typical. These are generally fairly substantial and rigid and unsuitable for mailing. Other photographic displays include various picture frames such as shown in Design Pat. Nos. 253,507 and 253,742 in which the frame has indicia carved into it to provide a message with an open area to display a picture.

Other display systems are not as bulky such as those disclosed in Bacharach, U.S. Pat. No. 2,547,359, Alves, U.S. Pat. No. 2,878,607, Atkins, U.S. Pat. No. 2,926,444 and Carroll, U.S. Pat. No. 4,890.402. These provide a way to combine a photograph with a greeting card. They are generally designed to hold one or two photographs and further they can convey messages which are printed around the photograph.

SUMMARY OF THE INVENTION

The present invention is a photograph display system which can be used to convey a variety of different messages and display multiple photographs in a holder having several different pockets. Each pocket receives one photograph and a separate panel which forms a letter. The letter exposes a large portion of the photograph. Each section or pocket can be used to display one letter and one photograph. These can be combined to spell out a variety of different words. The photograph display system of the present invention is versatile and inexpensive to manufacture. However it provides an impressive photographic display. The other objects and advantages of the present invention will be appreciated in light of the following detailed description and drawings in which:

DETAILED DESCRIPTION

Figure 1A:
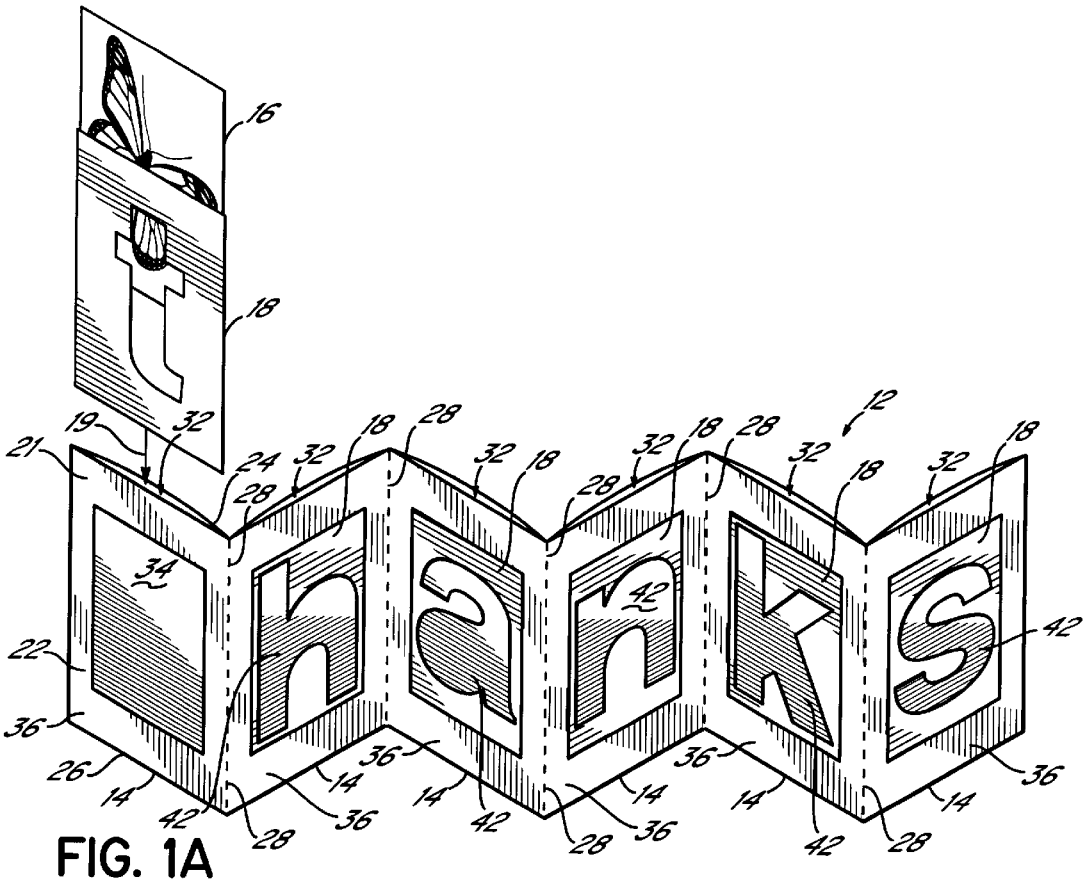
FIG. 1A is a perspective view partially exploded of the present invention.

The present invention is a photograph display 12 which includes a plurality of sections 14. Each section holds a photograph 16 and a panel 18. Each of the panels 18 defines or shows a figure or character such as a letter, numeral or other indicia.

More particularly the photograph display 12 of the present invention is formed from a long sheet 21 of, for example, paper which includes a front side 22 and a back side 24 separated by fold lines 28. The individual sections 14 of photograph display 12 are separated by perforations 28 which allow the sections to be folded in an accordion-type manner as shown in FIG. 1A. The front side and back side are held together by glue lines, not shown, on either side of each perforation 28 forming pockets 32 in each section 14.

Figure 1B:
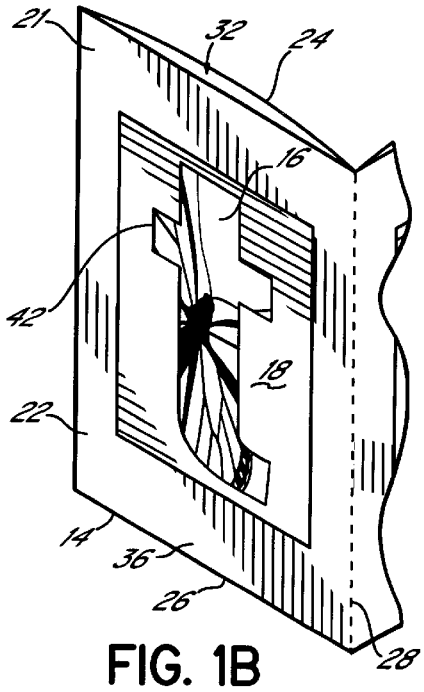
FIG. 1B is an assembled view of FIG. 1A partially broken away.

Each pocket 32 is adapted to receive an opaque panel 18 and a photograph 16. In the embodiment shown in 1A and 1B, the photograph is obviously a butterfly and the panel 18 has a cut-out portion which forms the figure "t", part of the word "thanks". The front side of each section 14 includes an open area 34 and a border area 36. The open area 34 is simply a cut-out portion or a transparent portion which allows the panel and picture to be shown. The border area 36 can be relatively narrow. Each opaque panel 18 has the figure portion 42 which is cut-out through the panel 18 which allows the portion of the photograph behind the figure portion 42 to be viewed through the panel 18 and through the front side 22 of the section 14 as shown in FIG. 1B.

In place of a cut-out figure portion, the figure or letter can simply be a transparent portion of the otherwise opaque panel 18. In either embodiment the panel 18 will permit only selected portions of the picture to be viewed.

It is contemplated that the photo display 12 will be more or less a continuous strip of the different sections 14 folded in accordion fashion. An individual would choose the desired number of sections and separate them from the continuous strip of sections at a perforation. The individual then selects the different panels having different figures to insert into each of the pockets 32 of each of the sections 14. The combined panels would convey a message or image. A photograph is inserted between the panel 18 and the back portion 24 of each section as indicated by arrow 19. A large portion of each photograph is viewable through each figure portion 42 in each panel 18. Presumably a different photograph would be used in each pocket and different panels with different figures would be used in the pocket to spell out a word.

Figure 2:
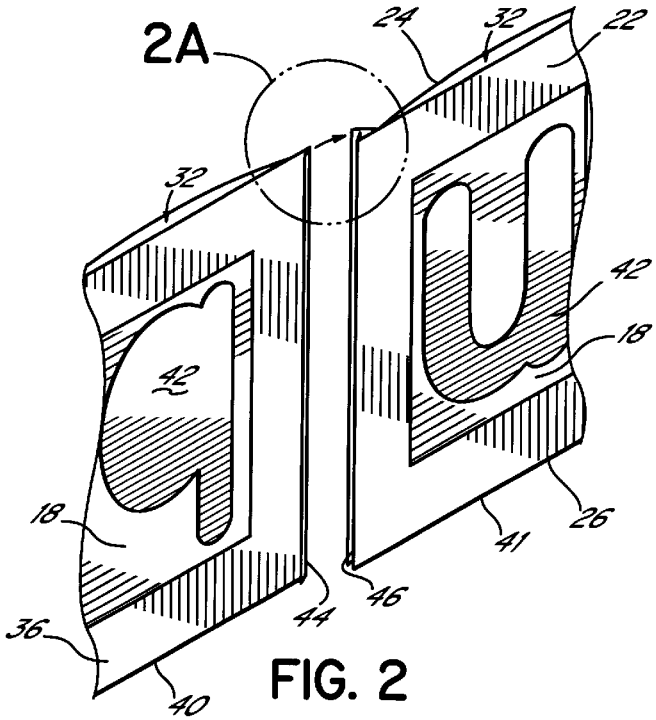
FIG. 2 is a perspective view of an alternate embodiment of the present invention.
Figure 2A:
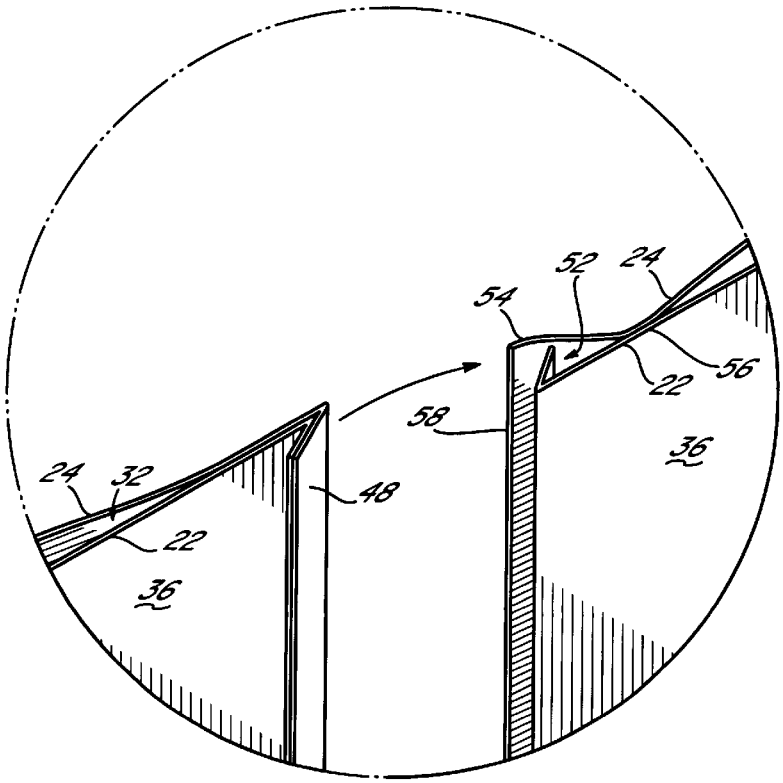
FIG. 2A is an enlarged section of FIG. 2.

FIG. 2 shows an alternate embodiment of the present invention in which instead of assembling the photographic display 12 from a continuous strip of sections 14 the different sections are assembled one at a time. In this embodiment the sections 40 and 41 are connected along edges 44 and 46. Edge 44 has both the front and rear sides 22 and 24 folded to form a J 48. Edge 46 on the other hand has the front side 22 folded to form a corresponding J 52 adapted to interlock with the J 48 formed at edge 44. This J 52 is formed between the glue line 56 and the edge 46 of card 41. The edge back side 24, however, simply forms a flap 54 from the glue line 56 to its extreme edge 58 and is adapted to hold the J 48 in the J 52. This is but one way different sections can be held together. Other ways of joining can be used such as adhesive tape, plastic hinges, clips, and the like.

In either of these embodiments, the panels 18 can either simply be an opaque sheet with the figure cut through the sheet or can be opaque in one area and transparent in another area to form the figure. It can be clear plastic with printing or other decoration forming the opaque portion.

Further the photographic display can be formed from a variety of different materials. Preferably it is formed from a cardboard stock to provide rigidity but at the same time take up a minimal space. Also it can be formed from a more flexible plastic with the rigidity provided by the panels and photographs themselves. Further although the present invention shows each of the sections holding a panel and a photograph, it is possible that certain of these sections would simply hold panels that had no photograph.

In a less preferred embodiment, the panels can be eliminated and the figures formed in the front sides of each section. This would be used if the photograph display is pre-assembled. In other words, a customer could purchase a pre-assembled card that spells a popular message as "Love", "Thanks" and so on. In this embodiment, open area 34, in front side 22 would be in the shape of a letter as opposed to a rectangle as shown in FIG. 1A.

The present invention is ideal for permitting an individual to create his own message. One can simply select the number of sections connected to each other and individually select the panels with the individual figures. As the display is formed from very flexible material, the supply of sections can be held in either a roll or in an accordion-type fashion taking up minimal amount of space. One simply needs to stock the individual figures which can be anything from numbers, shapes, punctuation marks such as exclamation marks, and the like. The figure could even be the profile of an individual's face. Thus the present invention provides a wide variety of different possibilities at very minimal cost.

This has been a description of the present invention along with the preferred method of practicing the invention. However, the invention itself should only be defined by the appended claims wherein

I claim:

1. A photograph display for a plurality of photographs comprising a plurality of sections;

each section having a pocket formed from a first side and a second side said pocket adapted to hold a photograph;

wherein said first side includes a frame portion and an exposed portion and a panel located in said pocket;

wherein a plurality of said panels include a cut-out figure comprising individual letters adapted to expose a significant portion of a photograph in said pocket between said panel and said second side wherein each of said sections are connected to each other; and wherein said display spells out a word formed of a plurality of said cut-out figures.

2. The photograph display claimed in claim 1 wherein each of said sections are hingedly connected to each other.

3. The photograph display claimed in claim 2 wherein said panels are hingedly connected to each other at a perforation line.

4. A photograph display system comprising a series of panels said panels having a plurality of separate sections said sections each having a pocket and connection means adapted to connect two panels;

each pocket having a first side and a second side each first side of each pocket having a figure portion said figure portion exposing a significant portion of a photograph in said pocket;

said pocket adapted to hold a photograph;

whereby a plurality of panels having different figures can be connected to each other by said connection means with the figures in said panels combined to convey a message.

5. A display for multiple photographs comprising a plurality of sections connected to each other;

a plurality of photographs mounted to each section;

a panel covering a first portion of said photograph and allowing a second portion of said photograph to be viewed wherein said portion which can be viewed comprises a figure and wherein different figures in said sections combine to form a message.

6. The photograph display claimed in claim 5 wherein said display is a unitary display wherein individual sections are hingedly connected to each other.

7. The photograph display claimed in claim 6 wherein said sections are separated by perforation lines.

8. The photograph display claimed in claim 6 wherein said panels are separable from each section.

9. A flexible photograph display comprising a front side and a back side connected along a bottom edge and a plurality of sections separated by fold lines between adjacent sections permitting said sections to be folded in an accordion fashion;

each section having a pocket open along a top edge;

each pocket adapted to hold a photograph;

each section having a front side adapted to hold a photograph in place and expose a large portion of said photograph; and whereby different exposed portions of photographs in said section combine to convey a message.

* * * * *